US008725041B2

(12) United States Patent
Takahashi et al.

(10) Patent No.: US 8,725,041 B2
(45) Date of Patent: May 13, 2014

(54) IMAGE FORMING APPARATUS WITH COUNTERMEASURES AGAINST INSTANTANEOUS FLUCTUATION DUE TO VIBRATION

(75) Inventors: Katsunori Takahashi, Hachioji (JP); Masashi Sugano, Hachioji (JP); Akinori Kimata, Toyokawa (JP); Akifumi Isobe, Hidaka (JP); Kenji Tamaki, Tokorozawa (JP); Satoshi Shimao, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 394 days.

(21) Appl. No.: 12/971,781

(22) Filed: Dec. 17, 2010

(65) Prior Publication Data

US 2011/0150530 A1 Jun. 23, 2011

(30) Foreign Application Priority Data

Dec. 22, 2009 (JP) ..... 2009-290500

(51) Int. Cl.
*G03G 15/00* (2006.01)
*G03G 15/16* (2006.01)
*G03G 15/01* (2006.01)

(52) U.S. Cl.
USPC ..... 399/167; 399/45; 399/66; 399/302

(58) Field of Classification Search
USPC ..... 399/167, 66, 313, 302, 308, 45
See application file for complete search history.

(56) References Cited

U.S. PATENT DOCUMENTS

| | | | | |
|---|---|---|---|---|
| 4,561,762 | A * | 12/1985 | Watanabe et al. | 399/167 |
| 5,250,999 | A * | 10/1993 | Kimura et al. | 399/66 |
| 7,907,872 | B2 | 3/2011 | Komatsu et al. | |
| 2004/0179857 | A1 * | 9/2004 | Oka et al. | 399/302 |
| 2004/0217538 | A1 * | 11/2004 | Kawamura | |
| 2006/0182477 | A1 * | 8/2006 | Takiguchi et al. | |
| 2007/0025768 | A1 * | 2/2007 | Komatsu et al. | 399/167 |

(Continued)

FOREIGN PATENT DOCUMENTS

| | | | |
|---|---|---|---|
| JP | 09015927 A | * | 1/1997 |
| JP | 09-117176 | | 5/1997 |

(Continued)

OTHER PUBLICATIONS

European Search Report dated Jul. 8, 2011.

(Continued)

*Primary Examiner* — Susan Lee
(74) *Attorney, Agent, or Firm* — Buchanan Ingersoll & Rooney PC

(57) ABSTRACT

An image forming apparatus including, a photosensitive body for carrying toner images, a transfer section for nipping the recording sheet at a position facing the photosensitive body and transferring the toner images carried on the photosensitive body onto a recording sheet, a driving section for driving the photosensitive body, and a control section for giving instructions to the driving section to conduct a velocity control to rotate the photosensitive body at a predetermined velocity, wherein the control section sets a gain of velocity control to be greater than normal condition, at a time which is at least one of a time when the recording sheet enters the transfer section, or a time when the recording sheet separates from the transfer section.

19 Claims, 8 Drawing Sheets

(56) References Cited

U.S. PATENT DOCUMENTS

| | | | | |
|---|---|---|---|---|
| 2008/0175612 | A1* | 7/2008 | Oikawa et al. | 399/66 |
| 2009/0123197 | A1* | 5/2009 | Okumura et al. | |
| 2009/0154964 | A1* | 6/2009 | Tsuruya | 399/308 |
| 2009/0279926 | A1* | 11/2009 | Yahagi | 399/308 |
| 2010/0008689 | A1* | 1/2010 | Iwasaki et al. | 399/66 |
| 2010/0135681 | A1* | 6/2010 | Yanagi | 399/66 |

FOREIGN PATENT DOCUMENTS

| | | | |
|---|---|---|---|
| JP | 10207261 | A * | 8/1998 |
| JP | 2001-265127 | | 9/2001 |
| JP | 2002162876 | A * | 6/2002 |
| JP | 2004-61882 | | 2/2004 |
| JP | 2004-317739 | | 11/2004 |
| JP | 2006-085153 | | 3/2006 |
| JP | 2006-259208 | | 9/2006 |

OTHER PUBLICATIONS

Notice of Reasons for Refusal mailed May 21, 2013 by Japan Patent Office in corresponding Japan Patent Application No. JP 2009-290500 (5 pages).

English-language translation of Notice of Reasons for Refusal mailed May 21, 2013 by Japan Patent Office in corresponding Japan Patent Application No. JP 2009-290500 (7 pages).

The First Office Action mailed Mar. 7, 2011 by State Intellectual Property Office of People's Republic of China in corresponding China Patent Application No. CN 201010610698.0 (7 pages).

English-language translation the First Office Action mailed Mar. 7, 2011 by State Intellectual Property Office of People's Republic of China in corresponding China Patent Application No. CN 201010610698.0 (7 pages).

* cited by examiner

FIG. 6a
PRIMARY TRANSFER POSITION WHEN PRECEDING SHEET SEPARATES

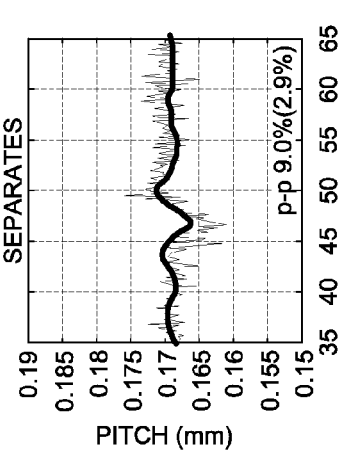

FIG. 6b
PRIMARY TRANSFER POSITION WHEN SHEET ENTERS

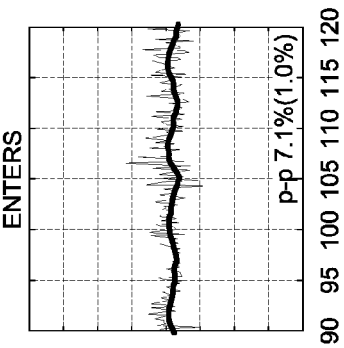

FIG. 6c
EXPOSURE POSITION WHEN PRECEDING SHEET SEPARATES

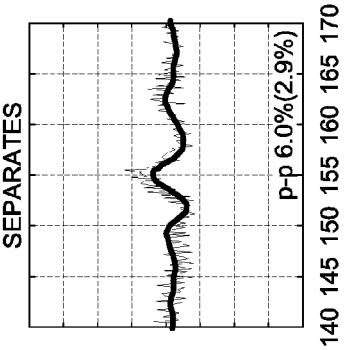

FIG. 6d
EXPOSURE POSITION WHEN SHEET ENTERS

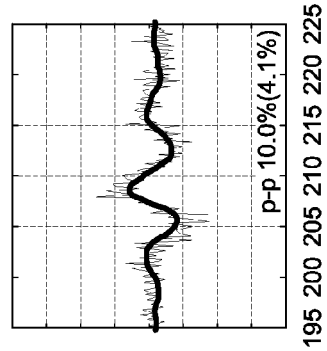

FIG. 6e
PRIMARY TRANSFER POSITION WHEN PRECEDING SHEET SEPARATES

FIG. 6f
PRIMARY TRANSFER POSITION WHEN SHEET ENTERS

FIG. 6g
EXPOSURE POSITION WHEN PRECEDING SHEET SEPARATES

FIG. 6h
EXPOSURE POSITION WHEN SHEET ENTERS

IMAGE FORMING APPARATUS WITH COUNTERMEASURES AGAINST INSTANTANEOUS FLUCTUATION DUE TO VIBRATION

CROSS REFERENCE TO RELATED APPLICATION

This application is based on Japanese Patent Application No. 2009-290500 filed on Dec. 22, 2009 with the Japanese Patent Office, the entire content of which is hereby incorporated by reference.

TECHNICAL FIELD

The present invention relates to image forming apparatuses, such as copy machines and printers, and in particular, to countermeasures against cases in which instantaneous fluctuation, concerning the driving speed of intermediate transfer bodies or image carriers, occurs, due to impulsive vibrations which occur when a recording sheet enters or separates from transfer areas at which the recording sheet is conveyed, while being nipped between rollers and the intermediate transfer body or the image carrier.

BACKGROUND ART

There are image forming apparatuses in which toner images carried on an image carrier are transferred onto recording sheets, while transfer areas of the image forming apparatuses nip the recording sheet between the image carrier and transfer sections (being transfer rollers).

Further, on said image forming apparatuses, when the recording sheet enters the transfer area or separates from the transfer area, on which area the image carrier and the transfer section are structured to be in contact with each other, adverse impulsive vibration occurs. Said impulsive vibration causes instantaneous speed-fluctuations of the image carriers, whereby while the images are formed, the images receive an adverse affect, which is a well known matter.

The thicker the recording sheet, the more drastically the velocity fluctuation occurs, when the recording sheet enters or separates from the transfer area. By said velocity fluctuation, notable adverse deterioration of image quality may locally occur, such as image transferring slippage on the transfer section, or uneven exposure of the image.

Patent documents, listed below, disclose the countermeasures against the instantaneous speed-fluctuation of the image carriers, which occur due to the vibrations which occur around the transfer area, when the recording sheet enters the transfer area or draws away from the transfer area.

Patent Document 1: Unexamined Japanese Patent application publication 2001-265,127, and Patent Document 2: Unexamined Japanese Patent application publication 2004-61,882

According to Patent Document 1, a structure to mechanically control an impulse is disclosed, so that any adverse effect of the impulse is controlled. However, since a specific mechanical structure is necessary, an apparatus increases in cost.

According to Patent Document 2, an intermediate transfer belt and a secondary transfer belt are individually rotated by a separate motor, while these belts are driven at a predetermined relative speed. When a recording sheet enters a secondary transfer section, a synchronization control is temporarily stopped, so that the relative speed between the intermediate transfer belt and the secondary transfer belt is controlled not to exceed a set limit. In this case, an operation mode is assumed to be necessary, so that an additional motor will be used for the synchronization control, which does not exhibit the general versatility.

Further, in general terms, in order to control the above-described vibrations, if the structural stiffness of the apparatus is increased, the vibration can be theoretically controlled. However, from the view point of the size of apparatus, the installation position of a flywheel, the cost of the flywheel, and the total cost of the apparatus, it is difficult to increase the structural stiffness to be greater than that of the present apparatuses.

Still further, in general terms, in order to control the above-described vibrations, soft rollers, which are configured to absorb the impulses when the recording sheet enters or separates from the transfer section, may be used for the transfer rollers and feeding rollers of conveyance sections. However, said soft rollers cannot be used as the transfer rollers, from the view point of transfer efficiency and image quality.

SUMMARY OF THE INVENTION

Since the present invention has been achieved to solve the above problems, an object of the present invention is to realize an image forming apparatus in which deterioration of images, due to instantaneous fluctuation of velocity of the intermediate transfer body or the image carrier, is prevented, wherein said instantaneous fluctuation of velocity occurs due to the impulsive vibrations which occur when the recording sheet enters or separates from the nipping section described above.

To achieve the abovementioned object, an image forming apparatus reflecting one aspect of the present invention comprises:

a photosensitive body for carrying toner images;

a transfer section for transferring the toner images earned on the photosensitive body onto a recording sheet, wherein the transfer section is adapted to nip the recording sheet by rotating bodies at a position facing the photosensitive body, a driving section for driving the photosensitive body, and a control section for instructing the driving section to conduct velocity control to rotate the photosensitive body at a predetermined velocity, wherein the control section is adapted to set a gain of the velocity control to be higher than a normal operation, at a time which is at least one of a time when the recording sheet enters the transfer section, or a time when the recording sheet separates from the transfer section.

Concerning the invention of this image forming apparatus, the control section sets the gain of velocity control to be greater than normal condition for at least one of driving of the image carrier driven by the driving section or driving of the transfer section to be driven by the driving section, at a time when the recording sheet enters the transfer section or at a time when the recording sheet separates from the transfer section. Accordingly, impulsive fluctuation of the driving velocity of the intermediate transfer section, or the image carrier, which fluctuation occurs when the recording sheet enters or separates from the transfer section, can be more effectively controlled than normal condition, whereby deterioration of the image quality, due to the impulsive vibrations, can be effectively controlled.

BRIEF DESCRIPTION OF THE DRAWINGS

Embodiments will now be detailed, by way of example only, with reference to the accompanying drawings which are meant to be exemplary, not limiting, and wherein like embodiments are numbered alike in the several figures, in which:

FIGS. 6*a*-6*h* show the clearance of formed images, wherein their original images are lines, aligned in the scanning direction, having the same pitch in a sub-scanning direction.

DETAILED DESCRIPTIONS OF THE PREFERRED EMBODIMENTS

Figure 1:
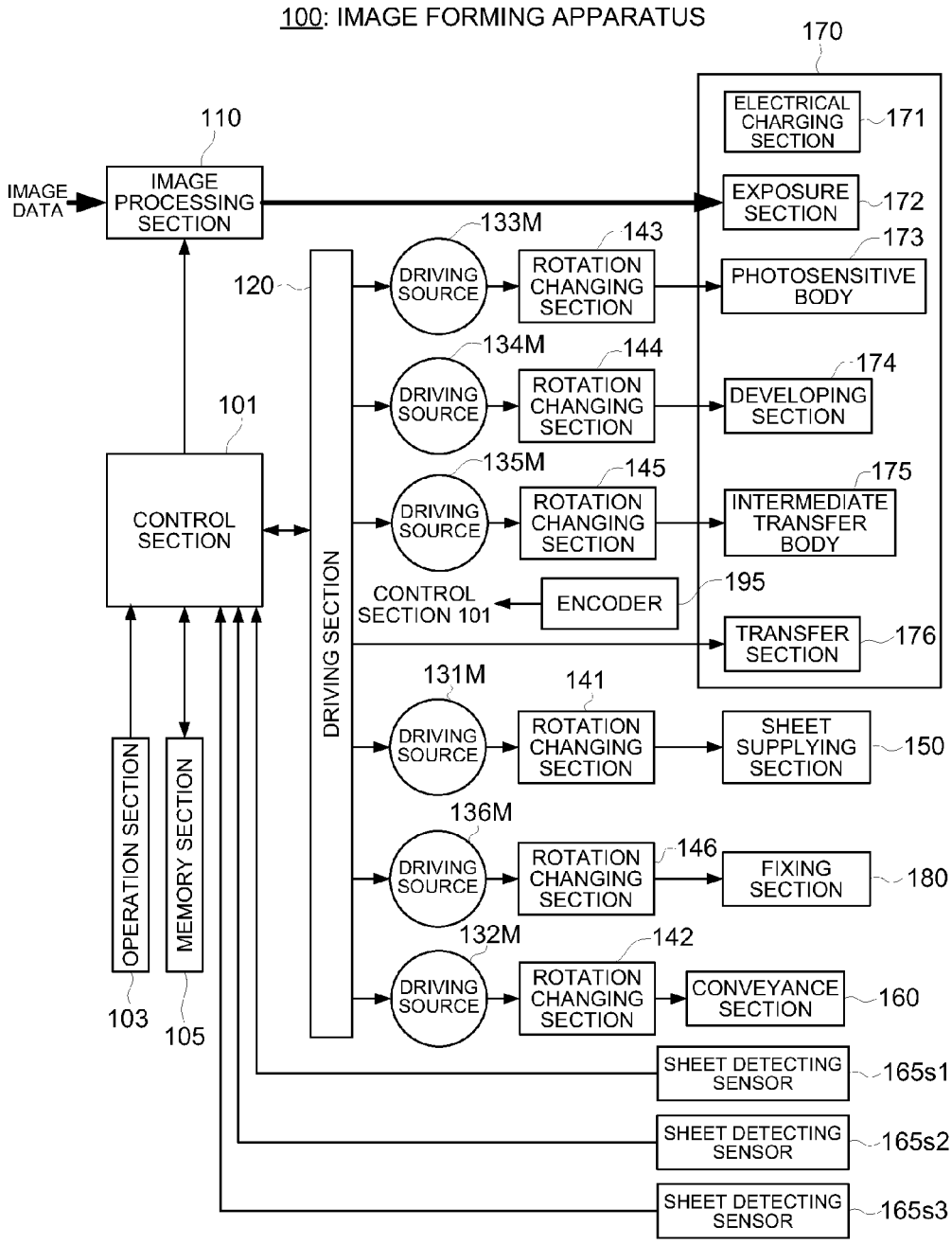
FIG. 1 shows a block diagram of an image forming apparatus as an embodiment of the present invention.

The best embodiments to achieve the present invention will now be detailed while referring to the drawings.

Structure of the Best Embodiment

Figure 2:
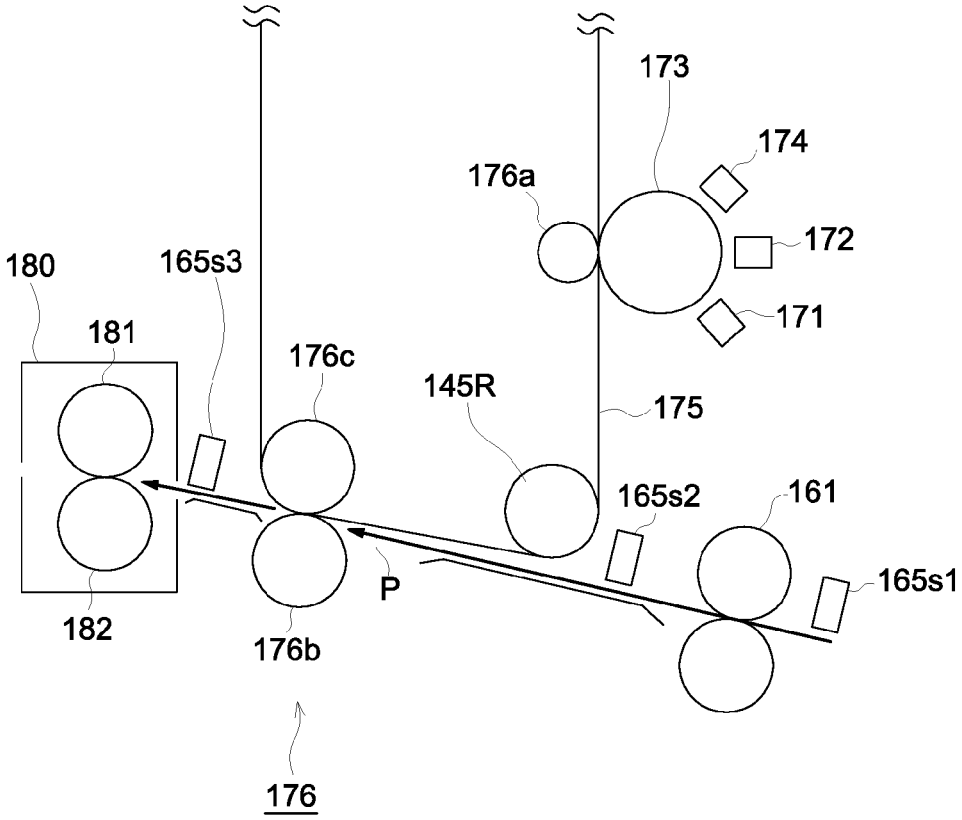
FIG. 2 is a cross-sectional view to show a photosensitive body, an intermediate transfer body, and their proximity.

A structure of image forming apparatus 100 will now be detailed while referring to FIGS. 1 and 2, wherein the electrical structure will be detailed in FIG. 1, and the mechanical structure will be detailed in FIG. 2.

In FIGS. 1 and 2, well-known sections in the image forming apparatus, and general sections which are not related to the present invention, are omitted from the explanations.

In image forming apparatus 100, control section 101 is structured of a CPU or the like, to control various sections of image forming apparatus 100. Control section 101 has functions to change control data, such as gain of the velocity control, against the velocity fluctuation which is given to a predetermined velocity of the image carrier by the vibrations which occur when recording sheet P passes between the image carrier and the transfer section.

In case that control section 101 is structured to be an overall control section and a print control section, one of, overall control section, both overall control section and print control section, and only print control section, can work for the above velocity control. In this embodiment, control section 101 includes the above three states for the explanation.

The operator inputs various operations for the image formation through operation section 103. For example, a type of recording sheets P, or a sheet tray is selected for the image formation, and selected information is sent to control section 101.

Memory section 105 stores various data. In the present embodiment, data for timing and data for gain values are stored, which data are used when an effective gain of velocity control is applied to the velocity fluctuation which occurs based on the type of sheet P.

When the specific sizes of recording sheets P are accommodated in each sheet tray, control section 101 preferably pairs each sheet tray and control data, such as velocity fluctuation data. Accordingly, the operator inputs the characteristics of various recording sheets P, that is, the operator inputs classifying data, such as types of sheet P (being normal sheet, or coated sheet), sheet weight classification, sizes of sheet P, or the like, through operation section 103. Control section 101 determines control data, such as velocity control data, based on the types of recording sheets P accommodated in plural sheet trays. Further, control section 101 memorizes the control data for each tray in memory section 105, based on the characteristics (which is classifying data) of the recording sheets, accommodated in each tray.

To make image data as an adequate state for image formation, image processing section 110 conducts an image processing operation on the image data.

Driving section 120 drives motors, being driving sources, which are configured to rotate various sections at predetermined rotation rates.

Motor 131M is a driving source to rotate a sheet supplying roller of sheet supplying section 150. Motor 132M is a driving source to rotate conveyance rollers of each section of conveyance section 160. Motor 133M is a driving source to rotate photosensitive body 173, being a photosensitive drum. Motor 134M is a driving source to rotate a developing roller of developing section 174. Motor 135M is a driving source to rotate intermediate transfer body 175. These motors 131M-136M are totally referred to as motor 130M.

Control section 101 controls motor 131M to rotate photosensitive body 173, and motor 135M to rotate intermediate transfer body 175.

Velocity changing section 141 is a velocity changing mechanism to rotate the sheet supplying roller of sheet supplying section 150, at predetermined rotation velocity by the rotation force generated by motor 131M.

Velocity changing section 142 is a velocity changing mechanism to rotate the conveyance rollers of each section of conveyance section 160, at predetermined rotation velocity by the rotation force generated by motor 132M.

Velocity changing section 143 is a velocity changing mechanism to rotate the photosensitive body 173, being the photosensitive drum, at predetermined rotation velocity by the rotation force generated by motor 133M.

Velocity changing section 144 is a velocity changing mechanism to rotate the developing roller of developing section 174, at predetermined rotation velocity by the rotation force generated by motor 134M.

Velocity changing section 145 is a velocity changing mechanism to rotate intermediate transfer body 175, at predetermined rotation velocity by the rotation force generated by motor 135M.

Velocity changing sections 141-146 are totally referred to as velocity changing section 140.

Sheet supplying section 150 conveys the recording sheets P, accommodated in plural sheet trays, one by one to an image forming position, using the sheet supplying roller.

Conveyance section 160 conveys the recoding sheets, sent from sheet supplying section 150, at a predetermined conveyance velocity, including registration roller 161 and various conveyance rollers. Registration roller 161 nips a recording sheet at an upstream position of the transfer section, and conveys said sheet.

Sheet detecting sensors 165*s* (including 165*s*1, 165*s*2, 165*s*3, . . . , and 165*sn*) are arranged at predetermined positions on conveyance section 160. Detected results generated by each sensor 165*s* are sent to control section 101.

On an example shown in FIG. 2, sheet detecting sensor 165*s*1 is arranged upstream of registration roller 161, while sheet detection sensor 165*s*2 is arranged between registration roller 161 and intermediate transfer body driving roller 145R, and sheet detecting sensor 165*s*3 is arranged upstream of fixing rollers 181 and 182, with respect to the sheet conveying direction.

After each sheet detecting sensor, arranged upstream of each roller, detects the leading edge of a recording sheet, control section 101 can detect that the recording sheet arrives at each roller, after a predetermined time has passed.

Process unit 170, being an image forming unit which conducts various operations to form images on the recording sheet, is configured to include:

photosensitive body 1, serving as an image carrier which is exposed, while being rotated in a predetermined direction;

electrical charging section 171 to charge electricity onto photosensitive body 173;

exposure section 172 to expose photo sensitive body 173 based on image data developing section 174 to develop electrostatic latent images for red by exposure section 172 on photosensitive body 173 intermediate transfer body 175, structured of an endless belt to carry toner images transferred from photosensitive body 173; and secondary transfer section 176 including roller 176*c* and transfer roller 176*b*.

Intermediate transfer body 175 is rotated by intermediate transfer body driving roller 145R at a predetermined velocity, through motor 135M and velocity changing section 145 (see FIG. 2).

Transfer roller 176*a* is configured to transfer the toner images, formed on photosensitive body 173, onto intermediate transfer body 175, while transfer roller 176*b* is configured to transfer the toner images formed on intermediate transfer body 175 onto recording sheet P.

Transfer roller 176*b* is configured to nip recording sheet P with a rotating body at a position (being the transfer position) facing intermediate transfer body 175 serving as an image carrier, so that transfer roller 176*b* is a transfer section to transfer the toner images formed on intermediate transfer body 175, serving as the image carrier, onto recording sheet P.

Fixing section 180, located downstream of transfer roller 176*b*, nips to convey the recording sheet, so that fixing section 180 can conduct a fixing operation to permanently fix toner images on the recording sheet.

Encoders 195 (being velocity detection sections) are mounted in velocity changing sections 143-145 to detect velocity fluctuations of velocity changing sections 143-145, whereby detected results are sent to control section 101. Further, the encoders can be directly mounted on various motors.

FIG. 2 shows a monochromatic image forming apparatus, including process unit 170 (including electronic charging section 171, exposure section 172, photosensitive body 173, developing section 174, and transfer roller 176*a*), which apparatus is shown as a representative example for the explanation of one color device, but which is not limited to this example. A color image forming apparatus can be structured, if plural process units 170 (including electronic charging section 171, exposure section 172, photosensitive body 173, developing section 174, and transfer roller 176*a*) are arranged around intermediate transfer body 175, as plural color devices.

In case of the image forming apparatus, having intermediate transfer body 175 in FIG. 2, the transfer area is an area on which the toner images, carried on intermediate transfer body 175, are transferred onto a recording sheet, while the recording sheet is nipped. In case of an image forming apparatus, having no intermediate transfer body 175 (which is not illustrated), a transfer area is an area on which the toner images, carried on photosensitive body 173, are transferred onto the recording sheet, while recording sheet P is nipped.

Figure 8:
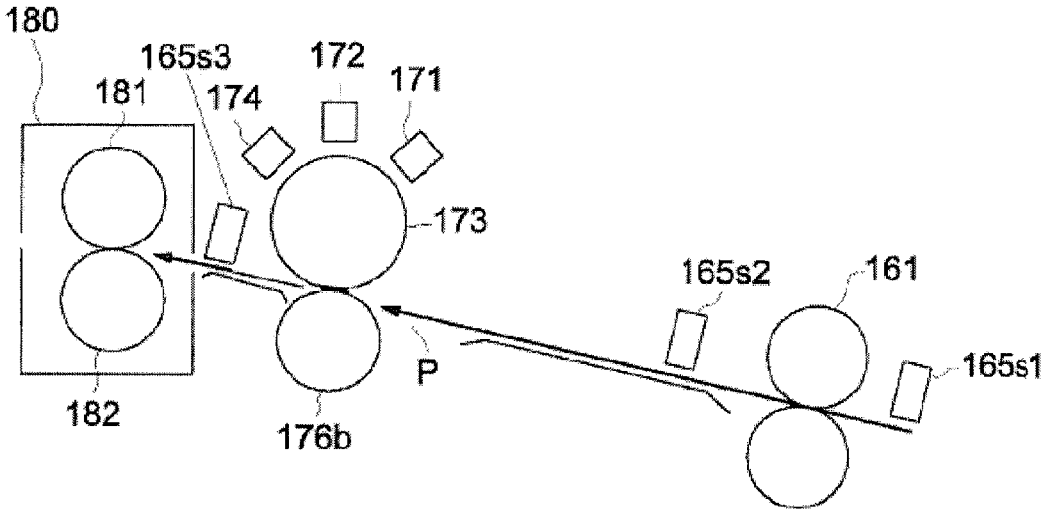
FIG. 8 is a cross-sectional view to show a transfer section for nipping a recording sheet at a position facing the photosensitive body.

FIG. 8 shows a monochromatic image forming apparatus. A color image forming apparatus can be structured, if plural process units (including electronic charging section 171, exposure section 172, photosensitive body 173, developing section 174 are arranged around transfer roller 176*b*, as plural color devices.

FIG. 8 shows a transfer section for nipping a recording sheet at a position facing the photosensitive body 173, and transferring the toner images carried on the photosensitive body 173 onto a recording sheet P.

Operation of the Embodiment

Figure 3:
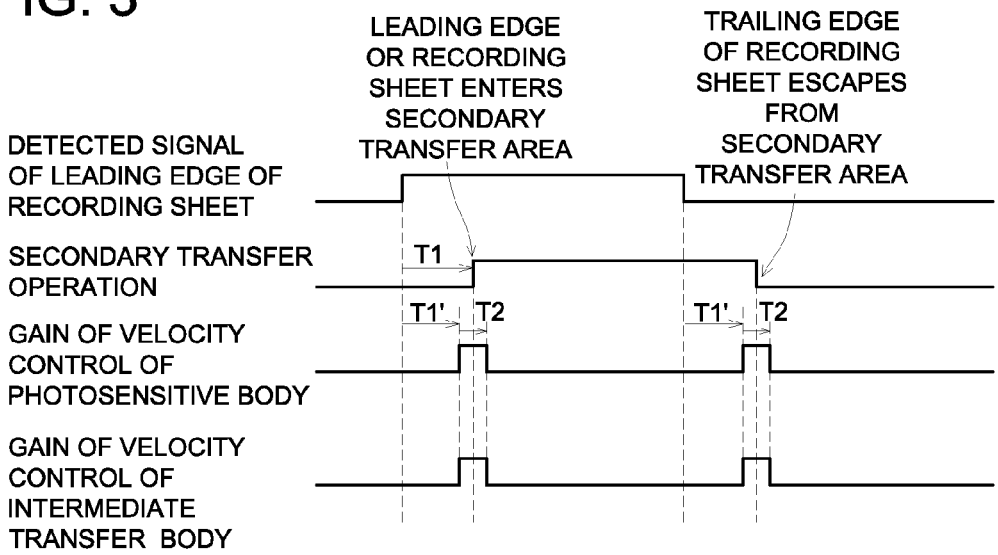
FIG. 3 is a time chart to show conditions of the image forming apparatus as the embodiment of the present invention.
Figure 4:
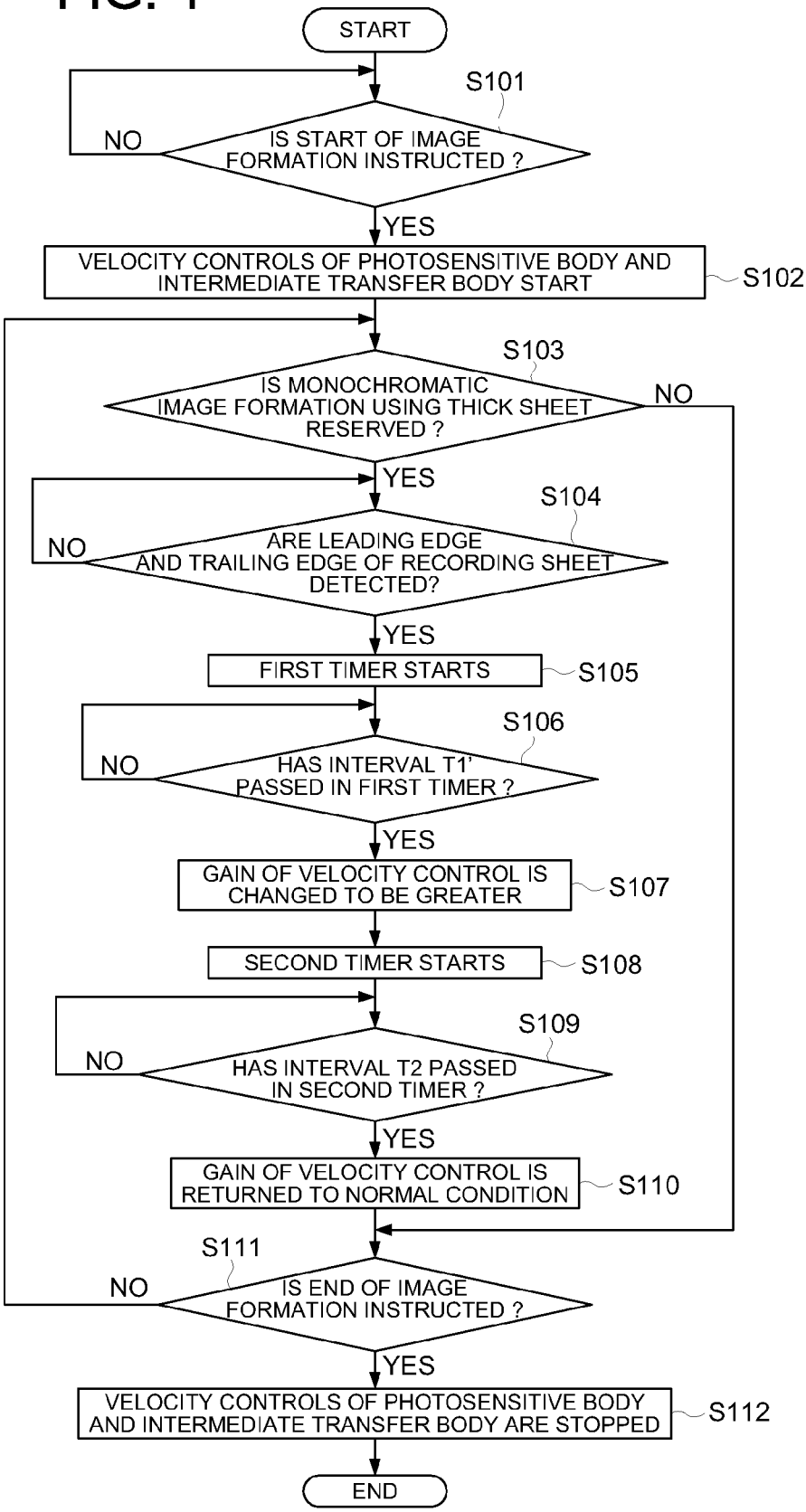
FIG. 4 is a flow chart to show the operation flow of the image forming apparatus as the embodiment of the present invention.

Concerning image forming apparatus 100 of the present embodiment, control of the velocity fluctuation will now be detailed, while referring to time charts shown in FIG. 3 and the flow chart shown in FIG. 4.

In the present embodiment, mainly detailed is the velocity fluctuation control, which is simultaneously conducted along with the normal control for the image formation.

Firstly, an instruction for outputting formed images is sent to control section 101 from operation section 103 or from an external personal computer (which is not illustrated) (Yes in step S101 in FIG. 4), control section 101 controls photosensitive body 173 and intermediate transfer body 175 to be driven at predetermined conveyance velocities, by predetermined velocity control, such as PI control (step S102 in FIG. 4).

Control section 101 and driving section 120 conduct the velocity control using a normal gain, based on detected results of encoder 195. In case to conduct the velocity control using PI control, a proportional gain for the proportional control (being the P control), and an integral gain for the integral control (being the I control) are provided, both controls are possible to operate without oscillation, whereby the gains can be previously determined to conduct a desired velocity control, and said gains are stored in memory section 105.

As the image forming output, control section 101 determines which is instructed between the color image formation or the monochromatic image formation, and sheet weight classification (which is instructed between the normal sheet or the thicker sheet), based on the job data (step S103 in FIG. 4).

In case that the color image formation has been instructed, or the thicker sheet is not instructed for the image forming output (No in step S103 in FIG. 4), control section 101 does not conduct a change of gain in the velocity control, and conducts the normal image formation, until an end of operation is instructed (steps S111 and S112 in FIG. 4).

In case that the thicker sheet has been instructed for the image forming output of the monochromatic image forming apparatus (Yes in step S103 in FIG. 4), or in case that the thicker sheet has been instructed for a monochromatic image forming output of the color image forming apparatus (Yes in step S103 in FIG. 4), control section 101 conducts the change of gain of the velocity control for a secondary transfer operation, using the way shown below.

After a recording sheet is supplied from sheet supplying section 150 for the image forming output, when sheet detecting sensor 165*s*2 detects the leading edge of said recording sheet (Yes in step S104 in FIG. 4), control section 101 makes a first timer to count time T1' (step S105 in FIG. 4).

As shown in FIG. 3, time T1 represents a time interval between a detected time of the leading edge of the recording sheet by sheet detecting sensor 165*s*2 and an arrival time of the recording sheet at the transfer area (being a position where intermediate transfer body 175 faces transfer roller 176*b*) (see FIGS. 3*a* and 3*b*). When the leading edge of the recording sheet enters the transfer area, or when the trailing edge of the recording sheet separates from the transfer area, the impulsive vibrations occur, so that impulsive fluctuations of the driving velocities of intermediate transfer body 175 and photosensitive body 173 occur, whereby time T2 represents a point of time for conducting the change of gain for the velocity control (see FIGS. 3*c* and 3*d*). Accordingly, the first timer counts time interval T1', wherein T1'=T1−α×T2 ("α" is nearly equal to 0.5).

T1 is determined by the distance between sheet detecting sensor 165*s*2 and the transfer area, and the conveyance velocity of the recording sheet, so that if the conveyance time is changed due to the type of sheet, T1 is also changed. Accordingly, if T1 is changed, T2 and T1' are also changed.

After sheet detecting sensor 165*s*2 has detected the leading edge of the recording sheet, and when control section 101 completes to count T1', using the first timer (steps S105 and S106 in FIG. 4), control section 101 reads out the gain of velocity control of photosensitive body 173 and the gain of velocity control of intermediate transfer body 175, from memory section 105, and control section 101 further changes the above gains to be values being greater than the normal values (step S107 in FIG. 4).

The velocity control of photosensitive body 173 represents a rotation velocity control of motor 133M which rotates photosensitive body 173. The velocity control of intermediate transfer body 175 represents a rotation velocity control of motor 135M which rotates intermediate transfer body 175.

The gain of velocity control is determined to be a value which can continuously control the velocity under the stable conditions, without generating the oscillation. The gain of velocity control is changed to a value greater than the normal value, wherein when said value is used, though the gain of velocity control may oscillate in the continuous condition, the gain does not oscillate during at least short time interval T2. Said value of the gain is determined in advance, and stored in memory section 105.

Further, when the first timer has completed to count T17, control section 101 increases the gain of velocity control, and simultaneously makes a second timer to count T2 (steps S108 and S109 in FIG. 4).

When the second timer has completed to count 12 (step S108 and S109 in FIG. 4), control section 101 reads out a gain of the velocity control of photosensitive body 173 and a gain of the velocity control of intermediate transfer body 175, from memory section 105, and exchanges the greater values, having been set in advance, to the normal values (step S110 in FIG. 4).

As detailed above, under the condition that a recording sheet just enters the transfer area, concerning at least one of the velocity control of photosensitive body 173 and the velocity control of intermediate transfer body 175, the gain of velocity control is set to be greater than the case under normal conditions. Accordingly, the impulsive fluctuation, which occurs on the driving velocity of intermediate transfer body 175 or photosensitive body 173, which is generated by the impulsive vibrations, when the recording sheet enters the transfer area where transfer roller 176*b* nips the recording sheet, is controlled to be greater than the case of the normal conditions, so that the deterioration of image quality, due to the impulsive vibrations, can be controlled more adequately.

If image formation is under the continuance (No in step S111 in FIG. 4), control section 101 controls the operation flow to return to step S103, and controls to repeat the above process. When the leading edge of the recording sheet enters the transfer area, the gain of velocity control is changed to be greater during time interval T2 and returns to the gain of the normal condition. In the same way as the above, when the trailing edge of the recording sheet just separates from the transfer area, the gain of velocity control is changed to be greater during time interval T2, and returns to the gain of the normal condition.

That is, after sheet detecting sensor 165*s*2 has detected the trailing edge of the recording sheet (step S104 in FIG. 4), control section 101 starts the first timer to count T1' (steps S105 and S106 in FIG. 4), subsequently, control section 101 reads out the gain of velocity control of photosensitive body 173 and the gain of velocity control of intermediate transfer body 175 from memory section 105, to make these gains to be greater than the normal values, which have been used (step S107 in FIG. 4). When the first timer has completed to count T1', control section 101 makes the gain of velocity control to be greater, simultaneously, control section 101 starts the second timer to count T2 (steps S108 and 109 in FIG. 4). After the second timer has completed to count T2 (steps S108 and 109), control section 101 reads out the gain of velocity control of photosensitive body 173 and the gain of velocity control of intermediate transfer body 175, from memory section 105, to change to the greater value, having been changed, to the normal value (step S110 in FIG. 4).

As detailed above, under the condition that a recording sheet just separates from the transfer area, concerning at least one of the velocity control of photosensitive body 173 and the velocity control of intermediate transfer body 175, the gain of velocity control is set to be greater than the case under the normal conditions. Accordingly, the impulsive fluctuation, which occurs on the driving velocity of intermediate transfer body 175 or photosensitive body 173, which is generated by the impulsive vibrations, when the recording sheet separates from the transfer area where transfer roller 176*b* nips the recording sheet, is controlled greater than the ease of the normal condition, so that the deterioration of image quality, due to the impulsive vibrations, can be controlled more adequately.

If the output operation of the image formation is under the continuance (No in step S111 in FIG. 4), control section 101 controls the operation flow to return to step S103, and controls to repeat the above process for a subsequent recording sheet. When the output operation of the image formation is instructed to complete (Yes in step S111 in FIG. 4), control section 101 completes the velocity control of photosensitive body 173 and the intermediate transfer body 175 (step S112 in FIG. 4).

Specific Example (1) of the Effect Obtained by the Present Embodiment

The effect, obtained when the present embodiment is applied to the image forming apparatus, will now be detailed. FIGS. 5*a*-5*d* show velocity fluctuation on the rotating velocity of photosensitive body 173, occurred due to the impulsive vibrations of the transfer area, which are measured by an encoder mounted on photosensitive body 173.

Figure 5A:
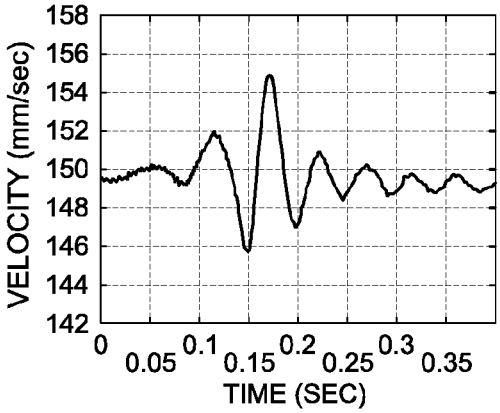
FIGS. 5*a*-5*d* show the fluctuation of rotation velocity of the photoconductor.
Figure 5B:
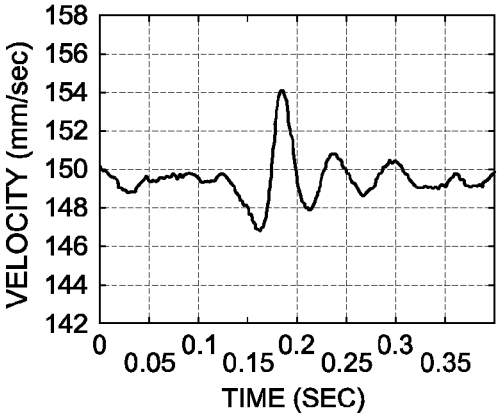

FIG. 5*a* shows the velocity fluctuation of photosensitive body 173, generated by the impulsive vibrations, when the leading edge of a recording sheet enters the transfer area, while FIG. 5*b* shows the velocity fluctuation of photosensitive body 173, generated by the impulsive vibrations, when the trailing edge of a recording sheet separates from the transfer area.

Figure 5C:
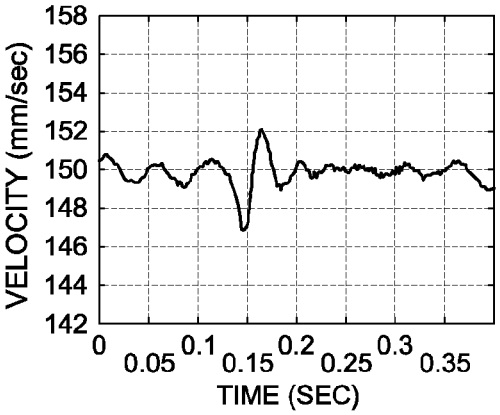
Figure 5D:
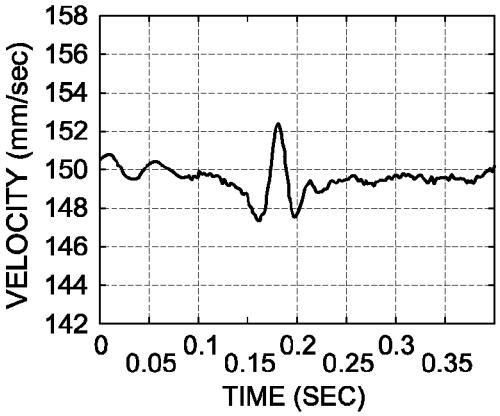

FIG. 5*c* shows the velocity fluctuation of photosensitive body 173, generated by the impulsive vibrations, when the leading edge of a recording sheet enters the transfer area, wherein a gain, which is 6 times greater than the normal gain, is applied, while FIG. 5*d* shows the velocity fluctuation of photosensitive body 173, generated by the impulsive vibrations, when the trailing edge of a recording sheet separates from the transfer area, wherein a gain, which is 6 times greater than the normal gain, is applied.

As understood by FIGS. 5*a*-5*d*, the impulsive velocity fluctuation of photosensitive body 173 decreases by half due to the velocity control used in the present embodiment, as a preferable result.

Further, in the present embodiment, since only the gain of velocity control is changed, even though wave forms are changed to be different in FIG. 5, the changed wave forms do not cause an adverse affect, so that the image forming operation can be conducted without problems.

Specific Example (2) of the Effect Obtained by the Present Embodiment

When the impulsive vibrations are generated in the transfer area, firstly said impulsive vibrations cause fluctuation of the driving velocity of intermediate transfer body 175, and elastic slippage (being turbulence) occurs on the toner image in a sub-scanning direction, while said toner image is transferred from the photosensitive body 173 to intermediate transfer body 175 as the first transfer operation.

Further, when the impulsive vibrations are generated in the transfer area, secondarily velocity fluctuation is generated on photosensitive body 173, being in contact with intermediate transfer body 175, so that elastic slippage (being turbulence) occurs on the electrostatic latent images in the sub-scanning direction, while said electrostatic latent images are exposed.

While the image formations are conducted on continuous recording sheets, when a preceding recording sheet separates from the transfer area, the image slippage occurs on a subsequent recording sheet, and when said subsequent recording sheet enters the transfer area, said image slippage occurs on said subsequent recording sheet. That is, when the image formations are conducted on the continuous recording sheets, the image slippages occur at a total of four positions on the images on the subsequent recording sheet and its following sheets.

Now, the image forming apparatus of the present embodiment forms images of plural lines, formed in a main scanning direction, which are aligned in the sub-scanning direction at a predetermined clearance (which is 0.17 mm). The clearances between each line are measured and shown in FIG. 6, whereby the influence of the impulsive vibrations, including the effect of the present embodiment, can be measured.

In detail in FIG. 6, actual measurements of the clearance between next to each line are shown by thin and broken lines, which lines fluctuate like a fine-toothed comb. The actual measurements values are averaged, and shown by a heavy curved line, which corresponds to actual conveyance velocity of the recording sheet.

FIG. 6*a* shows that when a preceding recording sheet separates from the transfer area under normal velocity control, image turbulence occurs on a subsequent recording sheet, due to image turbulence of a subsequent image, generated during the first transfer operation of said subsequent image.

FIG. 6*b* shows that when a recording sheet enters the transfer area under normal velocity control, image turbulence occurs on said recording sheet, due to the image turbulence, generated during the first transfer operation of said image.

FIG. 6*c* shows that when a preceding recording sheet separates from the transfer area under normal velocity control, image turbulence occurs on a subsequent recording sheet, due to the slippage of the exposure position of a subsequent image.

FIG. 6*d* shows that when a recording sheet enters the transfer area under normal velocity control, image turbulence occurs on said recording sheet, due to slippage of the exposure position of the image.

FIG. 6*e* shows that when a preceding recording sheet separates from the transfer area under velocity fluctuation control as well as normal velocity control, image turbulence occurs on a subsequent recording sheet, due to the image turbulence of the subsequent image, generated during the first transfer operation of said subsequent image.

FIG. 6*f* shows that when a recording sheet enters the transfer area under velocity fluctuation control as well as normal velocity control, image turbulence occurs on said recording sheet, due to the image turbulence, generated during the first transfer operation of said image.

FIG. 6*g* shows that when a preceding recording sheet separates from the transfer area under velocity fluctuation control as well as the normal velocity control, image turbulence occurs on the subsequent recording sheet, due to slippage of the exposure position of a subsequent image.

FIG. 6*h* shows that when a recording sheet enters the transfer area under velocity fluctuation control as well as normal velocity control, image turbulence occurs on said recording sheet, due to slippage of the exposure position of the image.

When comparing FIG. 6*a* to FIG. 6*e*, when comparing FIG. 6*b* to FIG. 6*f*, when comparing FIG. 6*c* to FIG. 6*g*, and when comparing FIG. 6*d* to FIG. 6*h*, we can clearly understand that velocity control of the present embodiment controls image slippage, due to the impulsive velocity fluctuation of intermediate transfer body 175 and photosensitive body 173, to minimize, so that said velocity control effectively decreases the image turbulence at the exposure during the first transfer operation, and results in the desired effect.

Variation of the Operation of the Structure of the Embodiments

Concerning the velocity controls of both photosensitive body 173 and intermediate transfer body 175, the above explanation of the embodiments, when the recording sheet enters the transfer area, and when the recording sheet exits from the transfer area, the gain of velocity control is changed to be greater. However, the present invention is not limited to this method.

For example, concerning velocity control of one of photosensitive body 173 and intermediate transfer body 175, when the recording sheet enters the transfer area, and when the recording sheet separates from the transfer area, the gain of velocity control is changed to be greater.

In this case, concerning photosensitive body 173 and intermediate transfer body 175, the gain of velocity control is changed to be greater for one body, which is closer to the transfer area than another body. Accordingly, the gain of velocity control is not changed to be greater for one body, which is farther from the transfer area than the other body.

Further, concerning photosensitive body 173 and intermediate transfer body 175, the gain of velocity control is changed to be greater for one body, which receives the influence of the velocity fluctuation more adversely than the other body. Still further, concerning the monochromatic image forming apparatus which does not include intermediate transfer body 175, the gain of velocity control is changed to be greater on photosensitive body 173.

Still further, not at both times when the recording sheet enters the transfer area, or when the recording sheet separates from the transfer area, that is, at one timing, the gain of velocity control is changed to be greater. Accordingly, concerning the impulse or the velocity fluctuation, generated when the recording sheet enters the transfer area, or when the recording sheet separates from the transfer area, the gain can be changed to be greater at the time of entrance or separation, which more adversely generates the impulse or the velocity fluctuation.

Still further, when the recording sheet enters the transfer area, or when the recording sheet separates from the transfer area, if no latent image or no toner image is formed on photosensitive body 173, the gain is not necessary to be changed. Still further if the impulse or the velocity fluctuation, generated when the recording sheet enters the transfer area, differs to that, generated when the recording sheet separates from the transfer area, it is also possible for the gain control that the individual gain is changed to be different values to each other for sheet entrance timing and sheet separation timing.

Still further, concerning the instantaneous fluctuation of the driving velocity of intermediate transfer body 175 or photosensitive body 173, generated due to the impulsive vibrations on the transfer area, said instantaneous fluctuation tends to occur, when the recording sheets exhibiting large sheet weight classification, such as the thick sheets, are used, whereby the gain of velocity control can be changed, in accordance with the sheet weight classification of the recording sheets. Accordingly, not only when the sheets, being thicker than normal use, are used, the gain can be changed, but also when the thicker sheets are usually used, the gain of the normal use is desirably set, based on the sheet thickness and the sheet weight classification of said thicker sheets.

Still further, concerning the instantaneous fluctuation of the driving velocity of intermediate transfer body 175 or photosensitive body 173, generated due to the impulsive vibrations on the transfer area, said instantaneous fluctuation tends to occur due to the hardness of the recording sheets, such as the coated sheets and the OHP sheets (being the resin sheets), even though the sheets exhibit the same thickness and the same weight. Accordingly, the gain of velocity control can be changed, based on the types of the recording sheets, additionally to the sheet weight classification, or instead of the sheet weight.

In the above explanations of the present embodiments, on a condition that the monochromatic image forming apparatus is used for forming monochromatic images, or on a condition that the color image forming apparatus is used for forming monochromatic images, when the recording sheet enters and separates from the transfer area, the gain of velocity control is changed to be greater. Because when the color image forming apparatus is used for forming monochromatic images, photosensitive body 173 of a single color is placed in pressure-contact with intermediate transfer body 175, while when the color image forming apparatus is used for forming the color images, photosensitive bodies 173 of four colors Y, M, C and K are in pressure-contact with intermediate transfer body 175, whereby velocity fluctuation during color image formation is controlled more effectively than velocity fluctuation during monochromatic image formation, so that the gain of velocity control during color image formation is not necessary to be changed.

However, during the color image formation of four colors, the instantaneous fluctuation of the driving velocity tends to occur to intermediate transfer body 175 or photosensitive body 173, due to the thickness and hardness of the recording sheets. Accordingly, even though, in case of color image formation, the velocity control, including the change of gain, is necessary.

Further, in case that two or three colors are used on the color image forming apparatus using four colors, Y, M, C, and K, if said apparatus has a mode in which only photosensitive bodies 173 of using colors are controlled to be in pressure-contact with intermediate transfer body 175, control section 101 is able to set a gain of velocity control to be greater, while the number of using colors becomes fewer.

Still further, if the conveyance velocity of the recording sheet is great, the instantaneous fluctuation of velocity tends not to occur, due to inertia of each section, while if the conveyance velocity of the recording sheet is low, instantaneous fluctuation of velocity tends to occur, due to inertia of each section. Accordingly, concerning the image forming apparatus, which is configured to change the sheet conveyance velocity during the image formation, control section 101 of said apparatus is preferably changes the gain of velocity control, based on the conveyance velocity of the recording sheet.

Still further, it is preferable that adequate gains of velocity control are stored in memory section 105 in advance, based on the fluctuation of parameters, such as the types of recording sheets, the sheet weight classification, the number of colors for color image formation, and the sheet conveyance velocity, whereby control section 101 can conduct the velocity control, while applying the appropriate gain.

Still further, in the above-described embodiments, the gain of velocity control are controlled to be higher in a rectangular wave, but the gain control is not limited to the rectangular wave. Since instantaneous fluctuation of velocity, generated due to impulsive vibrations, converges little by little, so that the gain, having been changed to a higher level, can be reduced little by little, or reduced in a staircase pattern, to the normal value.

That is, by changing the gain to an appropriate value, depending on the situation, instantaneous fluctuation of driving velocity of intermediate transfer body 175 or photosensitive body 173, which occurs when the recording sheet enters or separates from the transfer area, can be controlled to be an adequate condition, whereby deterioration of image quality, due to impulsive vibrations, can be appropriately controlled.

Further, in the above embodiments, countermeasures against turbulence of the image during exposure or primary transfer have been detailed, wherein said turbulence is generated by the instantaneous fluctuation of the driving velocity of photosensitive body 173 or intermediate transfer body 175, and said fluctuation is generated by the impulsive vibrations, while the recording sheet enters or separates from the transfer area, in which area, the recording sheet is nipped to be conveyed.

However, concerning timing at which a recording sheet has been nipped in the transfer area, and the trailing edge of said recording sheet separates from paired rollers, positioned upstream of the transfer area, in the sheet conveyance direction, or concerning timing at which a recording sheet has been nipped in the transfer area, and the leading edge of said recording sheet enters paired rollers, positioned downstream of the transfer area, in the sheet conveyance direction, wherein at least at one of the above timings, it is preferable that the gain of velocity control is set to be greater than normal condition for at least one of photosensitive body 173 or intermediate transfer body 175.

In this case, the paired rollers, positioned upstream of the transfer area, in the sheet conveyance direction, represent paired registration rollers 161 in FIG. 2. However, depending on the structure of the image forming apparatus, other paired conveyance rollers can be applied. Further, the paired rollers, positioned downstream of the transfer area, in the sheet conveyance direction, represent rollers mounted in fixing section 180 in FIG. 2. However, depending on the structure of the image forming apparatus, other paired conveyance rollers can be applied.

Figure 7:
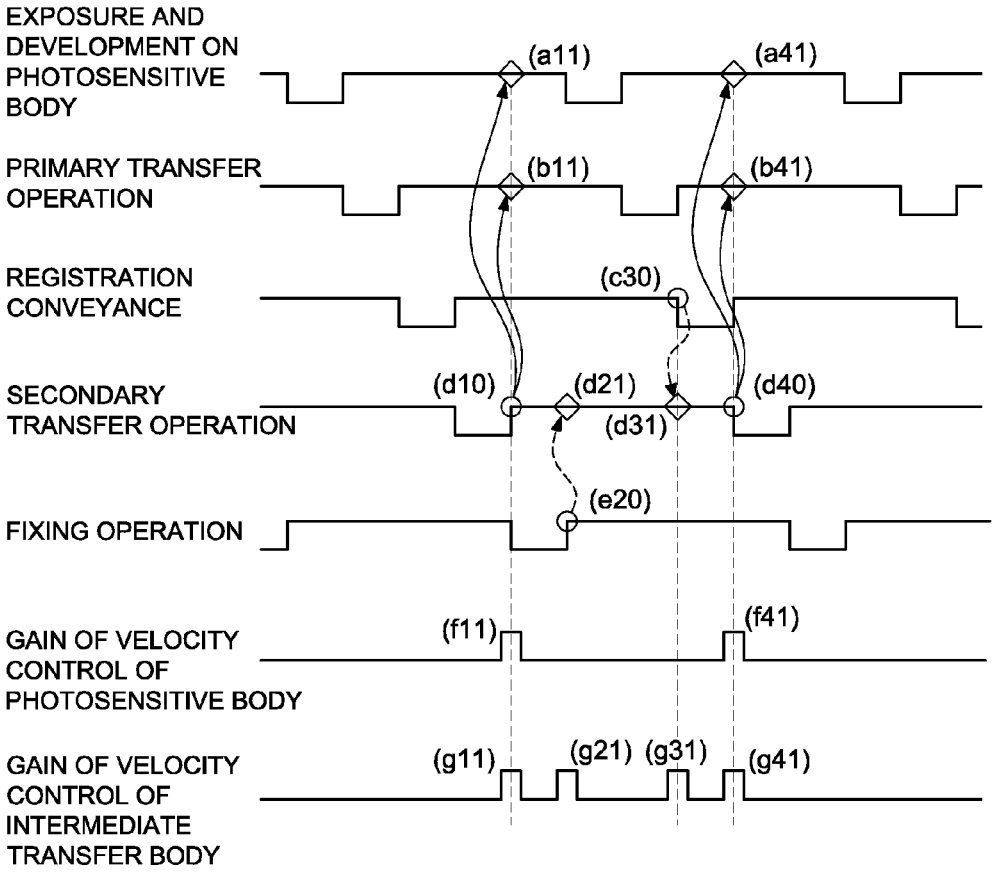
FIG. 7 show time charts of various sections.

The above conditions will be detailed, while referring to time charts shown in FIG. 7.

By the impulsive vibrations, which is generated when a recording sheet, being conveyed in a nipped condition, enters the transfer area (see portion d10 in FIG. 7), image turbulence occurs, as detailed above, during the exposure operation (see portion a11) and during the primary transfer operation (see portion b11).

By the impulsive vibrations, which is generated when a recording sheet, being conveyed in a nipped condition, separates from the transfer area (see portion d40), image turbulence occurs, as detailed above, during the exposure operation (see portion a41) and during the primary transfer operation (see portion b41).

As countermeasures against the above image turbulence, when the recording sheet enters the transfer area (see portion d10), the gain of velocity control of photosensitive body 173 is set to be greater than normal condition (see portion f11), and the gain of velocity control of intermediate transfer body 175 is set to be greater than normal condition (see portion g11).

Further, when the recording sheet separates from the transfer area (see portion d40), the gain of velocity control of photosensitive body 173 is set to be greater than normal condition (see portion f41), and the gain of velocity control of intermediate transfer body 175 is set to be greater than normal condition (see portion g41).

Still further, when the leading edge of the recording sheet, being the nipped condition, enters the fixing rollers (see portion e20), impulsive vibrations are generated by an entering motion of said leading edge, and the impulsive vibrations are transferred to the recording sheet, whereby slippage occurs during the secondary transfer (see portion d21) in the transfer area, so that image turbulence is generated to the recording sheet. In this case, control section 101 is configured to determine that the leading edge of the recording sheet enters the fixing rollers, by information from sheet sensor 165*s*3 and the sheet conveyance velocity. To overcome the image turbulence, control section 101 is configured to set the gain of velocity control of intermediate transfer body 175 to be greater than normal condition (see portion g21), just when the leading edge of the recording sheet enters fixing rollers (see portion e20).

Still further, when the trailing edge of the recording sheet, being the nipped condition, separates from registration rollers 161 (see portion c30), impulsive vibrations are generated by a separating motion of said trailing edge, and the impulsive vibrations are transferred to the recording sheet, whereby slippage occurs during the secondary transfer (see portion c31) at the transfer area, so that image turbulence is generated to the recording sheet In this case, control section 101 is configured to determine that the trailing edge of the recording sheet escapes from registration rollers 161, by information from sheet sensor 165*s*1 and the sheet conveyance velocity. To overcome the image turbulence, control section 101 is configured to set the gain of velocity control of intermediate transfer body 175 to be greater than normal condition (see portion g31), just when the trailing edge of the recording sheet escapes from registration rollers (see portion c30).

In addition, concerning timing when the leading edge of the recording sheet enters the fixing rollers (see portion e20), and timing when the trailing edge of the recording sheet separates from registration rollers (see portion c30), the order of both timings will be exchangeable, based on the structure of the image forming apparatus, and the size of the recording sheet.

Further, in the above explanations, the gain of velocity control of photosensitive body 173 is changed two times, being portions f11 and f41. However, said gain can be changed four times, to coordinate with portions g11, g21, g31 and g41 of intermediate transfer body 175.

Still further, in the above embodiments, even when the impulsive velocity fluctuation occurs due to the entrance and separation of the recording sheet, if exposure or developing operation is not conducted on photosensitive body 173, or if both primary and secondary transfer operations are not conducted on intermediate transfer body 175, it is not necessary that the gain of velocity control is changed.

Other Embodiments

In the above explanations, the velocity fluctuation is detailed, which is caused by the impulsive vibrations, when the recording sheet enters or separates from the transfer area, being the contacting area of intermediate transfer body 175 and transfer roller 176*b*. However, the embodiment is not limited to the above case.

For example, in case that an image forming apparatus transfers an image from photosensitive body 173 to a recording sheet by a fixing roller, without using intermediate transfer body 175, if velocity fluctuation is caused by an impulse which occurs when the recording sheet enters or separates from the transfer area, which is between photosensitive body 173 and the transfer roller, the gain of velocity control of photosensitive body 173 is also changed to be greater, so that the effective results can be obtained.

What is claimed is:

1. An image forming apparatus comprising:

a photosensitive body for carrying toner images;

a transfer section for nipping a recording sheet at a position facing the photosensitive body, and transferring the toner images carried on the photosensitive body onto a recording sheet;

a driving section for driving the photosensitive body; and a control section for giving instructions to the driving section to conduct a velocity control to rotate the photosensitive body at a predetermined velocity, wherein the control section sets a gain of velocity control to be greater than normal condition, at a time which is at least one of a time when the recording sheet enters the transfer section, or a time when the recording sheet separates from the transfer section, and wherein the control section does not change the gain, if an exposure operation and a developing operation are not conducted on the photosensitive body, though the recording sheet is at a time for going to enter the transfer section or the recording sheet is at a time for going to separate from the transfer section.

2. The image forming apparatus of claim 1,
wherein at least one of a time when the recording sheet, being nipped in the transfer section, separates from rollers mounted at more of an upstream position than the transfer section in a conveyance direction of the recording sheet, and a time when the recording sheet, being nipped in the transfer section, enters rollers mounted at more of a downstream position than the transfer section in a conveyance direction of the recording sheet, the control section sets the gain of velocity control to be greater than normal condition.

3. The image forming apparatus of claim 1,
wherein the control section sets the gain of velocity control, according to a type of the recording sheet, or a sheet weight classification.

4. The image forming apparatus of claim 1,
wherein the control section sets the gain of velocity control, according to a velocity driven by the driving section.

5. The image forming apparatus of claim 1,
wherein the control section sets the gain of velocity control to be different values, at the time when the recording sheet enters the transfer section, and at the time when the recording sheet separates from the transfer section.

6. The image forming apparatus of claim 1,
wherein the control section conducts a proportional-integral control as the velocity control, and changes the gain at the proportional-integral control.

7. The image forming apparatus of claim 1,
further comprising a sensor for detecting a time when the recording sheet arrives at the transfer section,
wherein the control section sets the gain of velocity control to be greater than normal condition, while referring to a result detected by the sensor.

8. The image forming apparatus of claim 1,
further comprising:
plural photosensitive bodies corresponding to toner images for plural colors, and
an intermediate transfer body on which the toner images are overlapped by the plural photosensitive bodies;
wherein the control section sets the gain of velocity control to be greater for a monochromatic image formation, and the control section does not set the gain of velocity control to be greater for a color image formation.

9. The image forming apparatus of claim 1,
further comprising a memory section for memorizing plural gains of the velocity control.

10. An image forming apparatus comprising:
a photosensitive body for carrying toner images;
an intermediate transfer body on which the toner images carried by the photosensitive body are transferred;
a transfer section for nipping a recording sheet at a position facing the intermediate transfer body, and transferring the toner images carried on the intermediate transfer body onto a recording sheet;
a driving section for driving the photosensitive body and the intermediate transfer body; and
a control section for giving instructions to the driving section to conduct a velocity control to rotate the photosensitive body and the intermediate transfer body at a predetermined velocity,
wherein the control section sets a gain of the velocity control of at least one of the photosensitive body and the intermediate transfer body to be greater than a normal condition, on a time which is at least one of a time when the recording sheet enters the transfer section, or a time when the recording sheet separates from the transfer section, and
wherein the control section does not change the gain, if an exposure operation or a developing operation is not conducted on the photosensitive body and a transfer operation is not conducted on the intermediate transfer body, though the recording sheet is at a time for going to enter the transfer section and the recording sheet is at a time for going to separate from the transfer section.

11. The image forming apparatus of claim 10, further comprising:
plural photosensitive bodies corresponding to toner images for plural colors, and
an intermediate transfer body on which the toner images are overlapped by the plural photosensitive bodies;
wherein the control section sets the gain of velocity control to be greater, as number of colors used for image formation are less.

12. The image forming apparatus of claim 10,
wherein at least one of a time when the recording sheet, being nipped in the transfer section, separates from rollers mounted at more of an upstream position than the transfer section in a conveyance direction of the recording sheet, and a time when the recording sheet, being nipped in the transfer section, enters rollers mounted at more of a downstream position than the transfer section in a conveyance direction of the recording sheet, the control section sets the gain of velocity control to be greater than normal condition.

13. The image forming apparatus of claim 10, wherein the control section sets the gain of velocity control, according to a type of the recording sheet, or a sheet weight classification.

14. The image forming apparatus of claim 10,
wherein the control section sets the gain of velocity control, according to a velocity driven by the driving section.

15. The image forming apparatus of claim 10,
wherein the control section sets the gain of velocity control to be different values, at the time when the recording sheet enters the transfer section, and at the time when the recording sheet separates from the transfer section.

16. The image forming apparatus of claim 10,
wherein the control section conducts a proportional-integral control as the velocity control, and changes the gain at the proportional-integral control.

17. The image forming apparatus of claim 10,
further comprising a sensor for detecting a time when the recording sheet arrives at the transfer section,
wherein the control section sets the gain of velocity control to be greater than normal condition, while referring to a result detected by the sensor.

18. The image forming apparatus of claim 10,
further comprising:
plural photosensitive bodies corresponding to toner images for plural colors, and
an intermediate transfer body on which the toner images are overlapped by the plural photosensitive bodies;
wherein the control section sets the gain of velocity control to be greater for a monochromatic image formation, and the control section does not set the gain of velocity control to be greater for a color image formation.

19. The image forming apparatus of claim 10,
further comprising a memory section for memorizing plural gains of the velocity control.

* * * * *